US006139070A

United States Patent [19]

Piltingsrud

[11] Patent Number: 6,139,070

[45] Date of Patent: Oct. 31, 2000

[54] INTEGRATED POWER WINDOW LOCK

[75] Inventor: Stephen M. Piltingsrud, Owatonna, Minn.

[73] Assignee: Truth Hardware Corporation, Owatonna, Minn.

[21] Appl. No.: 08/837,242

[22] Filed: Apr. 10, 1997

[51] Int. Cl.[7] ..... E05C 1/06

[52] U.S. Cl. ..... 292/144; 292/341.16

[58] Field of Search ..... 292/142, 144, 292/279, 341.16, DIG. 5, DIG. 33, DIG. 35, DIG. 47, 159–161

[56] References Cited

U.S. PATENT DOCUMENTS

| | | | |
|---|---|---|---|
| 4,500,122 | 2/1985 | Douglas | 292/161 |
| 4,610,472 | 9/1986 | Billingsley | 292/DIG. 35 |
| 4,991,886 | 2/1991 | Nolte et al. | 292/161 |
| 5,058,939 | 10/1991 | Miilu | 292/DIG. 5 |
| 5,143,412 | 9/1992 | Lindqvist | 292/DIG. 47 |
| 5,214,946 | 6/1993 | Antonello | 292/160 |
| 5,480,198 | 1/1996 | Wydler | 292/142 |
| 5,503,439 | 4/1996 | LaJeunesse | 292/160 |
| 5,503,441 | 4/1996 | Schwaiger | 292/144 |
| 5,642,909 | 7/1997 | Swan | 292/160 |

*Primary Examiner*—B. Dayoan
*Assistant Examiner*—Gary Estremsky
*Attorney, Agent, or Firm*—Wood, Phillips, VanSanten, Clark & Mortimer

[57] ABSTRACT

A window locking assembly is disclosed for selectively locking a window sash closed against a window jamb. The assembly includes a motor mounted to the window sash, the motor having an output drive shaft. A keeper is movably mounted to the window sash. A gear train operably connects the motor drive shaft to the keeper for controlling movement of the keeper. The motor moves the keeper to selectively engage the keeper with a cam member secured to the window jamb when the window sash is substantially closed against the window jamb.

34 Claims, 5 Drawing Sheets

INTEGRATED POWER WINDOW LOCK

FIELD OF THE INVENTION

This invention relates to a window lock and, more particularly, to a motorized window lock having a movable keeper.

BACKGROUND OF THE INVENTION

Movable windows in general use have a sash which is either sliding, double hung, or pivotal, with the latter type including awning and casement windows. Many different forms of window locks are available for locking a movable window.

With a casement window, for example, a typical window lock includes a ramped keeper fixedly mounted to the sash. A housing mounted to the frame includes a pivotal handle driving a cam member. With the window in the closed position the handle is pivoted to raise or lower the cam member to selectively engage or disengage the keeper.

In many instances, the window can be of such size or of a structural material which renders it desirable to have multi-point locking. It is known to mount individual window locks at spaced points or locations on the window to achieve multi-point locking. Typically, each of the window locks is independently operable. However, the movable mechanisms of a pair of window locks can be connected together for simultaneous movement from a single handle, as shown in U.S. Pat. No. 4,991,886, owned by the assignee of the present invention.

Recent developments have included automating window locking hardware such as with the use of motorized locks. Typically, this is accomplished by motorizing movement of the cam member discussed above to lock or unlock the window.

These past designs all relate to modifications in the locking hardware. The designs have not considered design of the window itself. This often results in sacrifices in performance and customer appeal. Some of the sacrifices include slow operating speed, hardware that is obtrusively large, unacceptably high noise levels, and high cost.

The present invention is directed to overcoming one or more of the problems discussed above in a novel and simple manner.

SUMMARY OF THE INVENTION

In accordance with the invention there is provided a window lock provided with a movable keeper.

Broadly, there is disclosed herein an assembly for selectively locking a window sash closed against a window jamb. The assembly includes a motor mounted to the window sash, the motor having an output drive shaft. A keeper is movably mounted to the window sash. Means operably connect the motor drive shaft to the keeper for controlling movement of the keeper. Means control the motor to move the keeper to selectively engage the keeper with a cam member secured to the window jamb when the window sash is substantially closed against the window jamb.

In accordance with one aspect of the invention, the keeper comprises a first keeper and the cam member comprises a first cam member and there is further included a second keeper movably mounted to the window sash, wherein the second keeper selectively engages a second cam member secured to the window jamb when the sash is substantially closed against the jamb. Means are provided for interconnecting the first keeper to the second keeper for movement therewith. The interconnecting means comprise a tie bar. There is also provided means for manually moving the first and second cam members between first and second positions, wherein the first and second cam members engage the first and second keepers only in the first position. The manually moving means comprises actuator means operably connected to the first cam member and a tie bar interconnecting the first and second cam members together.

In accordance with another aspect of the invention, there is provided manually operable means for releasing the operably connecting means to allow the keeper to move independent of the motor drive shaft.

In accordance with a further aspect of the invention, there is provided a frame disposable in a cavity defined in a generally rectangular box shape on a sash side, the motor and the operably connecting means disposed in the frame. The frame is comprised of a thermally non-conductive material, and is adhesively bondable within the sash cavity. The operably connecting means comprises a reduction gear set driven by the motor output drive shaft.

In accordance with another aspect of the invention, the gear reducing train comprises a first helical gear rotatable about a first axis driven by a first pinion rotatable about a second axis, parallel with the first axis, the first pinion being operably connected to a worm gear driven by the motor output shaft, and a second helical gear rotatably about a third axis, generally parallel to said first axis, and driven by a second pinion coaxial with and rotatable with said first helical gear, said second helical gear being operably connected to said operably connecting means.

In accordance with an additional aspect of the invention, the first and second helical gears and the first and second pinions comprise EVOLOID® gears.

In accordance with yet another aspect of the invention, the operably connecting means comprises a sliding member connected to said first keeper and having rack teeth axially disposed thereon and a pinion rotatable about said third axis and selectively connected to said second helical gear, said pinion engaging the rack teeth on said sliding member. The assembly further includes manually operable means for disconnecting the pinion from the second helical gear. The manually operable disconnecting means comprise an actuator movable between first and second position, wherein the actuator selectively connects said pinion with said second helical gear in said first position and disconnects said pinion from said second helical gear in said second position. The actuator is biased to said first position by a spring.

In accordance with a further aspect of the invention there is provided an assembly for selectively locking a window sash closed against a window jamb. The assembly includes a cam member secured to the window jamb. A keeper is movably mounted to the window sash. Drive means are mounted to the window sash for operably controlling movement of the keeper to selectively engage the keeper with the cam member when the window sash is substantially closed against the window jamb.

In accordance with one aspect of the invention there is provided means for manually moving the cam member between first and second positions, wherein the cam member engages the keeper only in the first position. The manually moving means comprises a lever hingedly mounted to the jamb and operably connected to the cam member for moving the cam member.

Further features and advantages of the invention will be readily apparent from the specification and from the drawing.

DETAILED DESCRIPTION OF THE INVENTION

Figure 1:
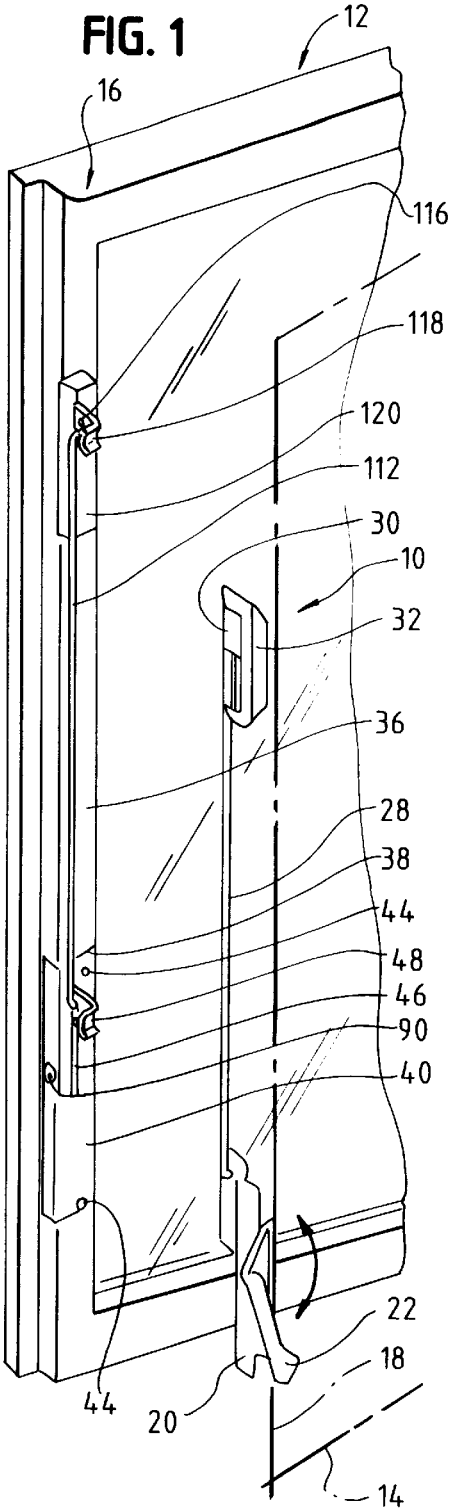
FIG. 1 is a partial perspective view showing a casement window having a motorized multi-point locking assembly according to the invention.

Referring to FIG. 1, a power window locking system 10 is mounted to a window 12. The window 12 includes a frame, shown generally in phantom at 14, and a window sash 16. In the illustrated embodiment, the window 12 comprises a casement window in which the sash 16 is pivotally mounted to the window frame or jamb 14, by suitable hardware, not shown.

It should be understood that though the description herein generally refers to casement windows, the present invention could also be used with a variety of different window types, including double-hung windows, awning windows, French windows and skylights, as well as windows made of a variety of different materials, such as wood or vinyl wrapped windows.

The power window locking system 10 described herein is only one example of a type of power window lock which would benefit from incorporating the features of the present invention. Though the particular locking structure such as disclosed herein may be advantageously used with the present invention, once a full understanding of the present invention is obtained, it should be recognized that still other lock configurations could also be advantageously used with the present invention.

The window frame 14 includes a vertical jamb, at 18. Mounted to the jamb 18 is a lock housing, not shown, including a fixed frame 20. The frame 20 pivotally mounts a handle 22, see also FIGS. 5 and 6. The handle 22 has a rounded distal end 23 received in a horizontal slot 24 of a ramped cam member 26. The cam member 26 is movable in the lock housing a linear vertical path caused by pivotal movement of the handle 22. A connecting rod 28, see FIG. 1, connects the cam member 26 to a cam member 30 in an upper housing 32, also on the vertical jamb 18. Owing to the connection with the connecting rod 28, the cam members 24 and 30 move in unison.

The housing 20 rotatably mounts the handle 22 for movement between two limit positions. One of these limit positions is the window locked position shown in FIG. 1 wherein the handle 12 extends downwardly. The handle can move to its other limitation, as indicated by the arrow in FIG. 1, to extend upwardly (not shown) to correspondingly lower the cam member 26. This movement of the handle is through an arc and correspondingly vertically moves the cam members 26 between first and second positions.

Figure 2:
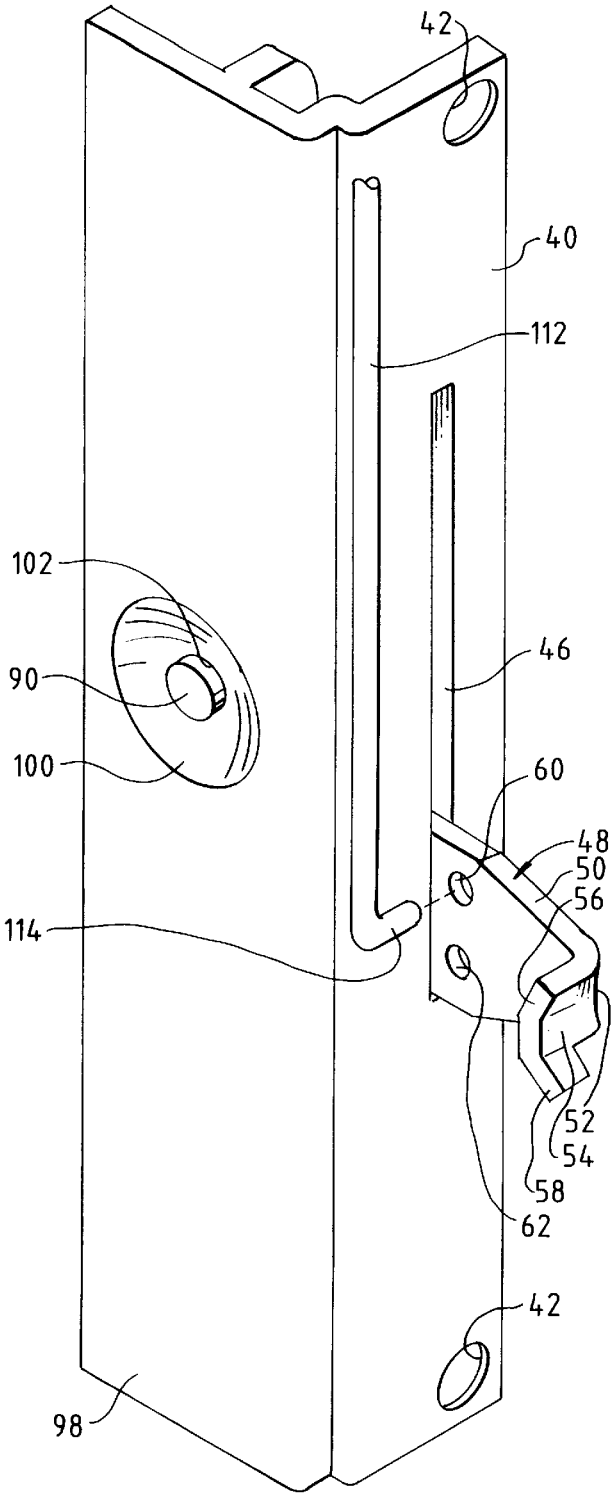
FIG. 2 is a perspective view of a portion of the assembly of FIG. 1 comprising a housing mountable to a window sash and including a movable keeper.

The cam members 26 operably co-act with related locking structure provided on the sash 12. Particularly, the sash 16 includes a vertical side 36 that abuts the vertical jamb 18 when the window is in the closed position, see FIG. 5. The vertical side 36 includes a cavity 38. A frame 40 is disposed in the cavity. Referring also to FIG. 2, the frame is of generally rectangular box shape and includes suitable openings 42 for receiving suitable fasteners 43, see FIG. 6, for securing the frame 40 within the cavity 38. An elongate slot 46 extends vertically in the frame at a position generally corresponding to position of the housing 20 when the window sash 16 is in the closed position. A keeper 48 is movably mounted to the frame 40. Particularly, the keeper 48 comprises a plate 50, turned at 52 at approximately a right angle to a generally planar section 54. The planar section 54 is disposed between opposite ramp sections 56 and 58. The plate includes a pair of vertically spaced openings 60 and 62, for reasons discussed below.

Figure 3:
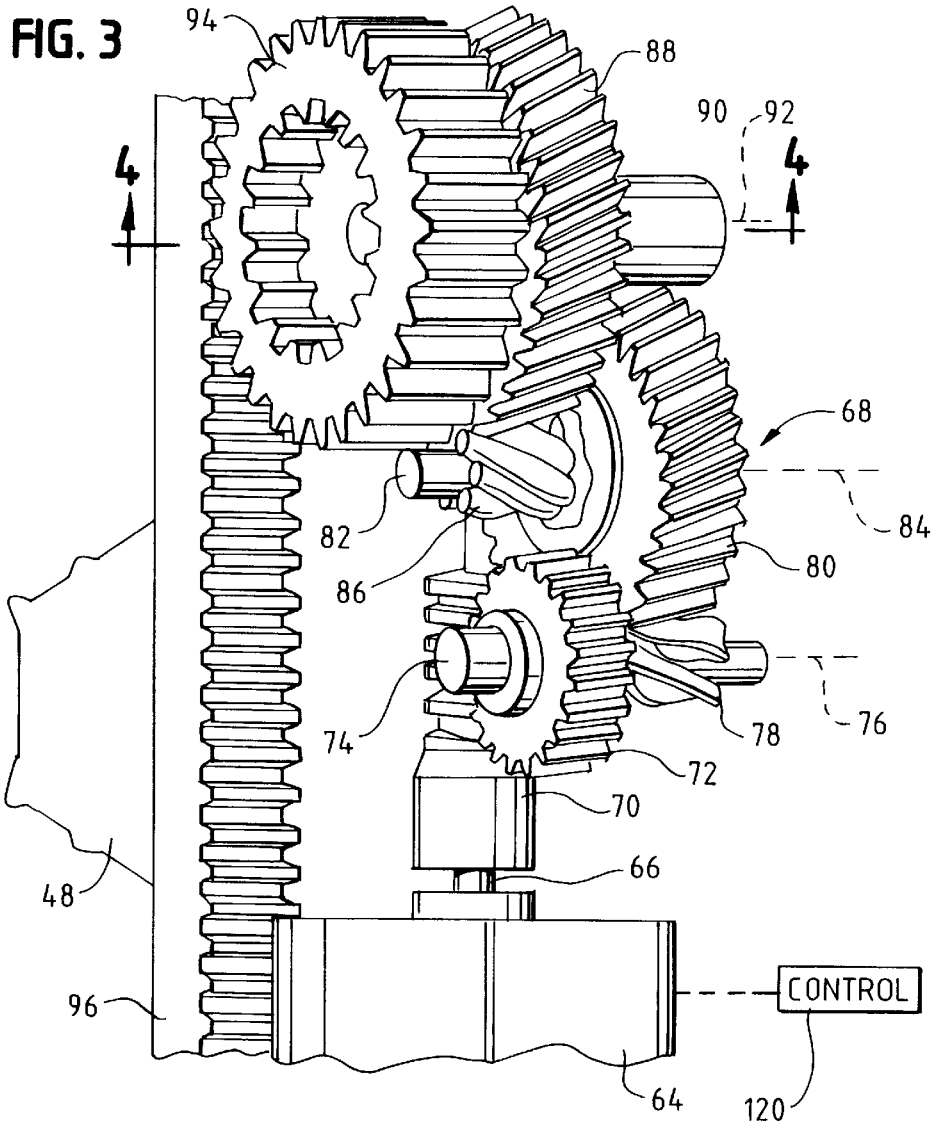
FIG. 3 is a partial perspective view illustrating a motorized gear drive for moving the keeper of FIG. 2.

Referring also to FIG. 3, a motor 64 is mounted to the frame 40 by suitable means, not shown. The motor has an output drive shaft 66. The motor output drive shaft 66 is operatively connected to the keeper 48 via a reduction gear set 68.

Figure 7:
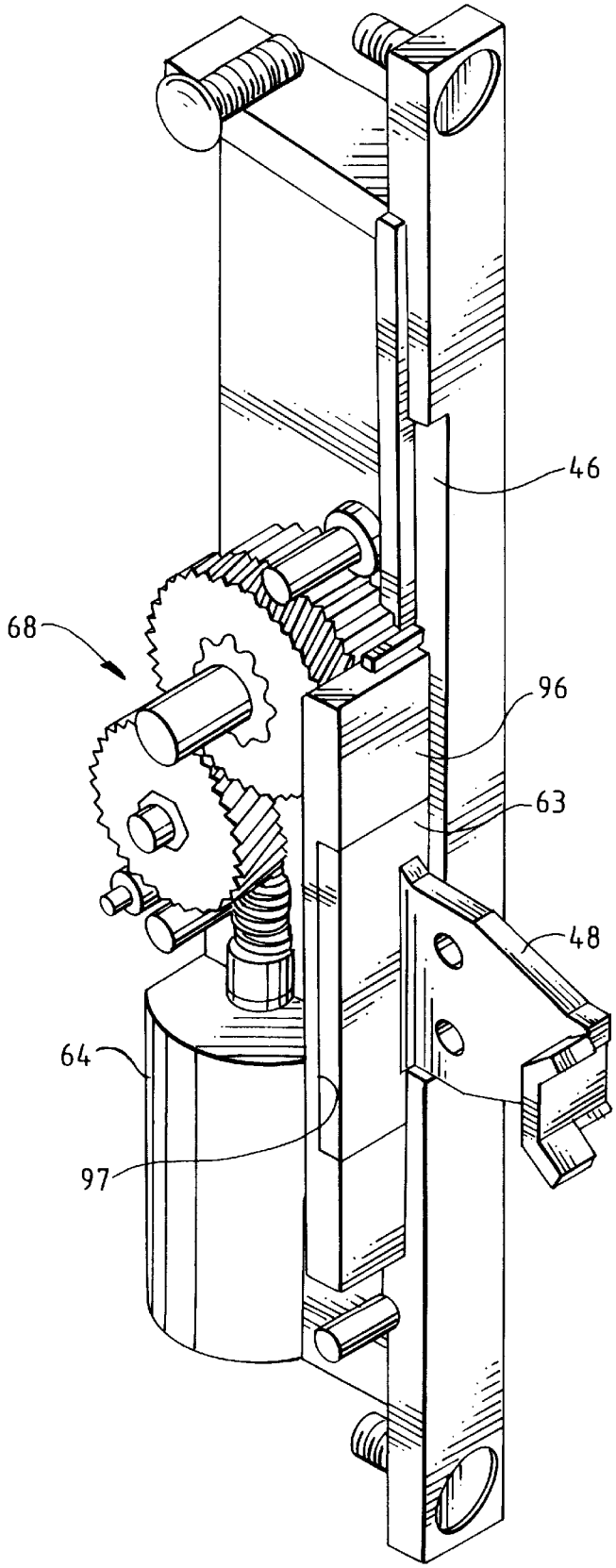
FIG. 7 is a perspective view, similar to FIG. 2, with a portion of the frame removed.

The reduction gear set 68 comprises a worm gear 70 connected to the drive shaft 66 for rotation therewith. A toothed wheel 72 is mounted to a shaft 74. The shaft is positioned so that the toothed wheel 72 is driven by the worm gear 70 for rotation about a first axis represented by a dashed line 76. Also connected to the axis 76 is a first pinion 78. The first pinion 78 engages a first helical gear 80 secured to a second shaft 82 for rotation about a second axis represented by a dashed line 84. Also connected to the second shaft 82 is a second pinion 86. The second pinion 86 engages a second helical gear 88 operatively connected to an actuator shaft 90 for rotation about a third axis represented by a dashed line 92. Also operatively connected to the shaft 90 is a third pinion 94. The pinion 94 drives a rack 96. The keeper 48 includes a back plate 63 received in a cavity 97 in the front side of the rack 96, see FIG. 7, for movement therewith. As a result, the keeper 48 moves linearly with the rack 96.

In accordance with the invention, the helical gears 80 and 88 comprise EVOLOID® gears. EVOLOID® gears use parallel axis pinions with small numbers of teeth meshing with specially designed helical gears to achieve relatively high ratios at high efficiencies. In accordance with the invention, a gear reduction ratio of approximately 750:1 is provided.

Figure 5:
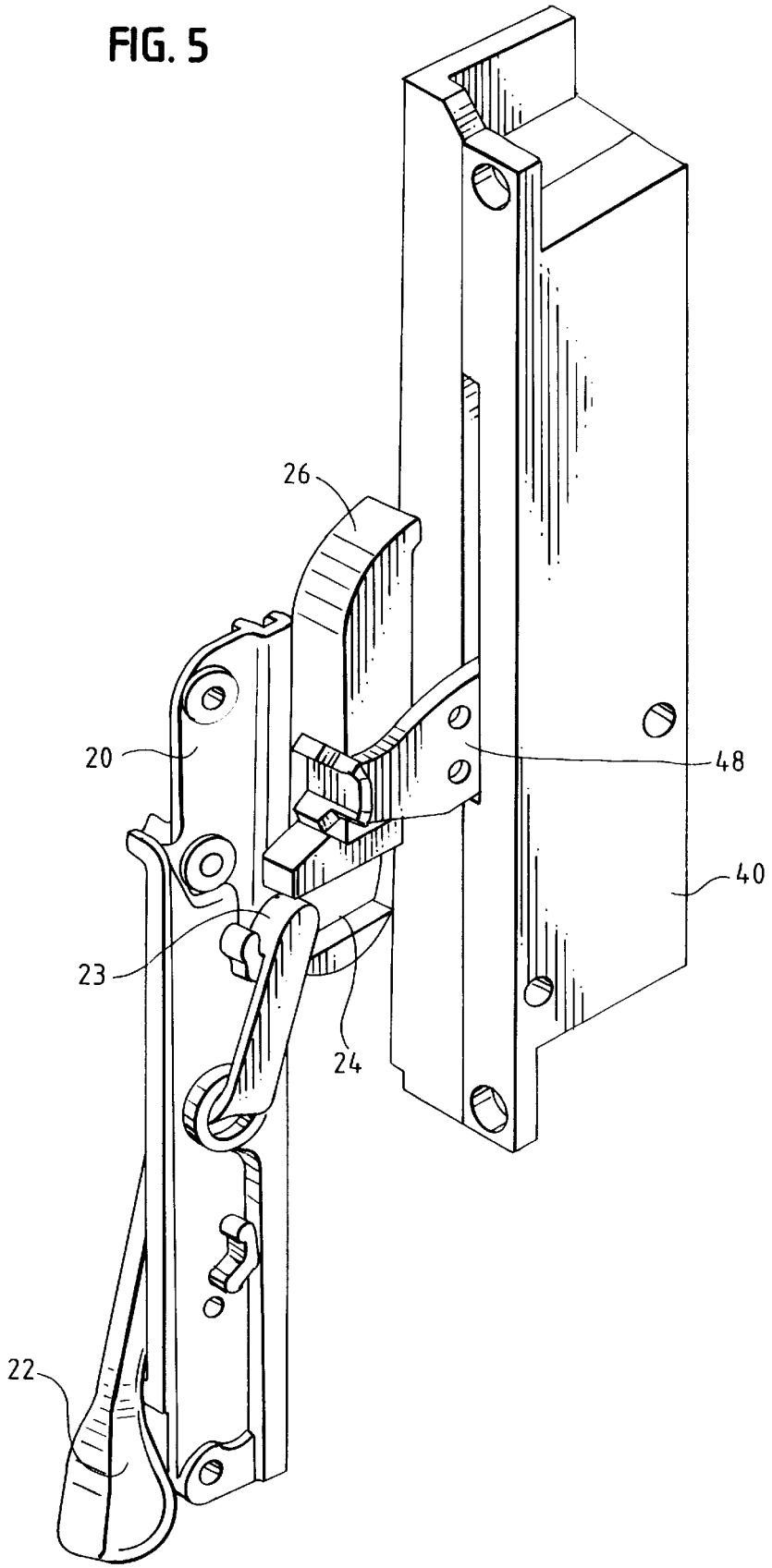
FIGS. 5 and 6 are perspective views of the assembly illustrating selective engagement of the movable keeper with a cam member.

Thus, in accordance with the invention, operation of the motor 64 causes vertical movement of the rack 96, and thus the keeper 48, for selectively locking or unlocking the window 12. Particularly, the motor 64 is used to move the keeper 48 to selectively engage the cam member 26, as shown in FIG. 5, to lock the sash 12 in a closed position as shown.

Figure 4:
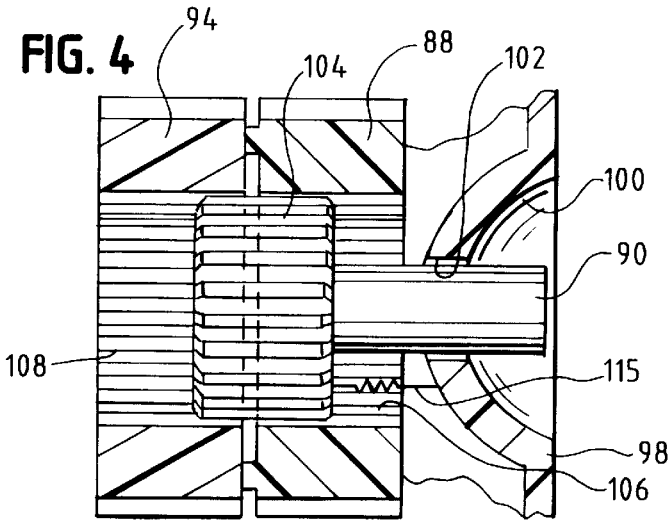
FIG. 4 is a sectional view taken along the line 4—4 of FIG. 3.

Referring again to FIG. 2, the frame 40 includes a side wall 98 including a concave cavity 100 disposed proximate the vertical position of the slot 46. The cavity 100 includes a central opening 102 receiving the actuator shaft 90. Referring to FIG. 4, the actuator shaft 90 supports a toothed wheel 104. The second helical gear 88 includes a toothed inner surface 106 for meshing with the toothed wheel 104. Similarly, the third pinion 94 includes an inner toothed surface 108 for engaging the toothed wheel 104. A spring, illustrated schematically at 110, connects the toothed wheel 104 to the frame side 98. The spring 106 biases the toothed wheel 104 to a position at which it engages both the second helical gear 88 and the third pinion 94. If necessary to disengage the keeper 48 from the gear reduction set, the actuator shaft 90 can be depressed so that the toothed wheel 104 no longer engages the second helical gear 88. As a result, the keeper 48 can be grasped and manually moved upwardly or downwardly, as necessary.

Referring again to FIGS. 1 and 2, a connecting rod 112 is turned at a lower end 114 to be received in the keeper upper opening 60. The connecting rod 112 is turned at an upper end 116 to be received in an opening 62 of a second keeper 118. The second keeper 118 is identical to the first keeper 48, except that it is not directly driven by a motor. Instead, the second keeper 118 is mounted for vertical movement within a second frame 120 also mounted in the vertical side 36. Movement of the second keeper 118 is controlled by the connecting rod 112, which is in turn controlled by the first keeper 48. The second keeper 118 operatively co-acts with the cam member 26 associated with the second slider 30 to provide multi-point locking of the window sash 16.

As described previously, the cam members 26 are movable between first and second positions. The first position is shown in FIG. 5 in which the cam member 26 engages the keeper 48 to selectively lock the window sash 16 closed against the window jamb 14. The second position is lower than the first position. The cam member 26 is moved from the first position to the second position by raising the handle 22, see FIG. 1, causing the cam member to move downwardly to the second position. In the second position the cam member 26 does not engage the keeper 48 so that the window sash 16 can be opened.

Figure 6:
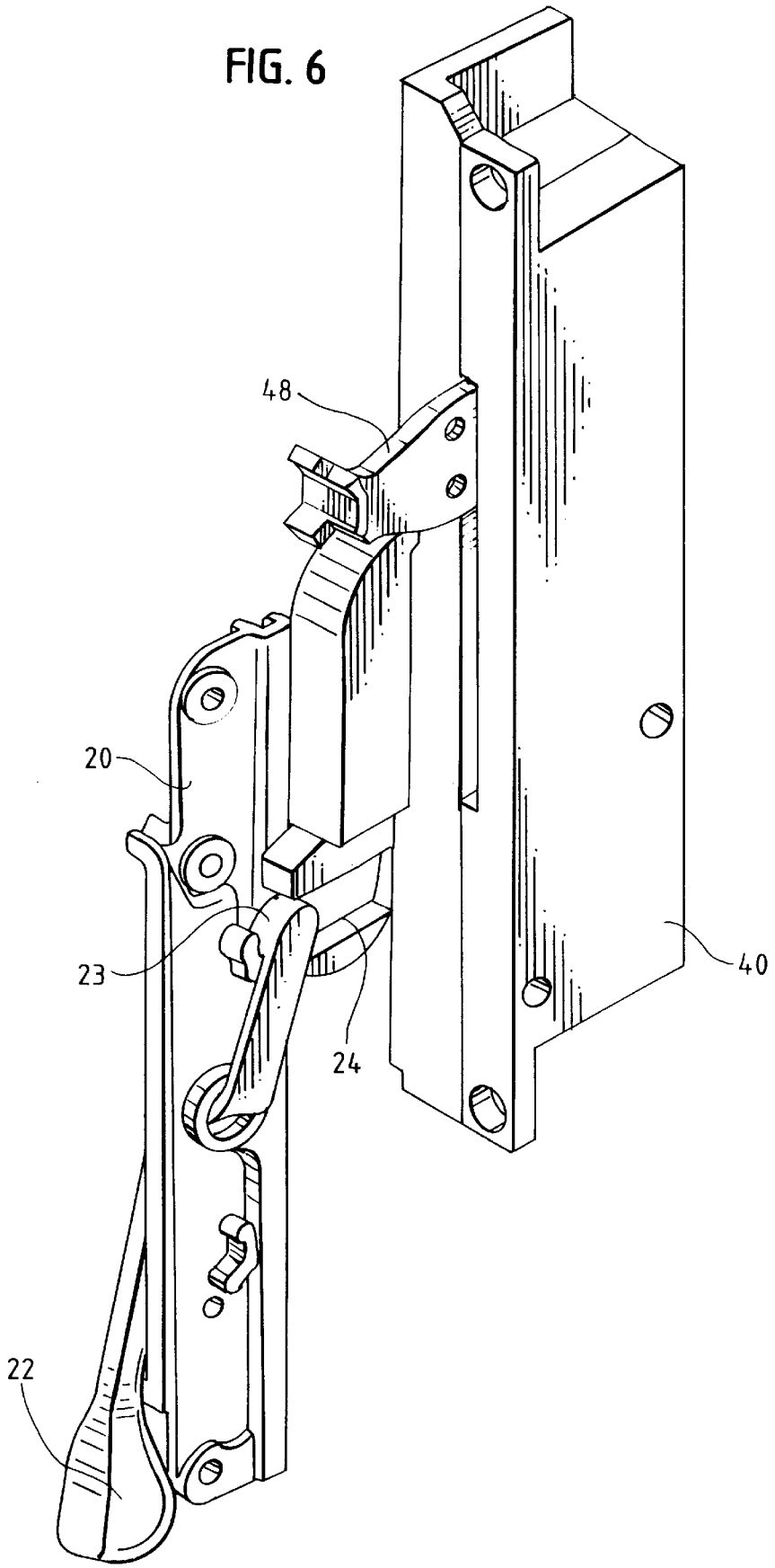

Likewise, the keeper 48 is movable between first and second positions. The first position is illustrated in FIG. 2 and FIG. 5. In the first position, the keeper 48 is at a relatively low position in the slot 46 and the keeper 48 engages the cam member 26 as shown in FIG. 5. The second position is illustrated in FIGS. 1 and 6, wherein the keeper 48 is shown at a higher relative position in the slot 46. When the keeper 48 is in the upper position, it is disengaged from the cam member 26 so that the window sash 16 is not locked closed against the window jamb 14.

The general operation of the power window locking system 10 is now described.

Assuming that the locking operation is to be normally motorized, the handle 22 is left in the downward position so that the cam member 26 is in the first position. The motor 64 is controlled by an electrical control 120 illustrated in block form in FIG. 3. The control 120 may take any known form which is adapted for selectively energizing the motor 64. As is apparent, the motor 64 can be controlled to rotate its drive shaft 66 in either direction to selectively raise or lower the keeper 48.

Assuming that the window 12 is locked, then the keeper 48 is in the first position shown in FIGS. 2 and 5. To unlock the window 12 the control 120 energizes the motor 64 so that the gear reducing train 68 drives the rack 96, and thus keeper 48, upwardly to the second position shown in FIGS. 1 and 6. Once the keeper 48 is in the upper position, then the window sash 16 can be opened by any suitable means, such as a window operator. Subsequently, when it is desired to lock the window sash 16 closed against the window jamb 14, the control 120 causes the motor 64 to turn its output shaft 66 in the opposite direction so that the gear reducing train 68 drives the rack 96, and thus keeper 48, downwardly to the first position shown in FIGS. 2 and 5.

In the event of a power outage, or if it is desired to lock the window manually, then the handle 22 may be used. Assuming the window sash 16 is closed, then the handle 22 can be raised in a conventional fashion to move the cam members 26 downwardly to the second or unlocked position. The window sash 16 can then be opened. Conversely, when the window sash 16 is returned to the closed position, it can be locked by lowering the handle 22 downwardly. As is apparent, for the window sash 16 to be locked closed against the window jamb 14, the cam member 26 must be in its first or uppermost position and the keeper 48 must be in the first or lowermost position. If the sash 16 is left open during a power outage or the like, it is necessary to move the keeper 48 to the first position in order to manually lock the system 10. This is accomplished by depressing the actuator shaft 90 sufficient so that the third pinion 94 is disengaged from the second helical gear 88. With these gears disengaged, the user can then manually move the keeper 48 downwardly to the first position. The actuator shaft 90 is then released and returned to the engaged position shown in FIG. 4 by action of the spring 110. The window sash 16 can then be closed and the handle 22 used for locking action. As is apparent, the handle 22 must be raised prior to closing the window and subsequently be lowered.

As described, the gear reducing train 68 includes two stages of parallel-axis helical EVOLOID® gears. This gear train achieves a reduction ratio of approximately 750:1 with significantly fewer gears than would be possible with ordinary spur gears. The gear train has the advantage of providing for the manual release mechanism as described, using minimal parts and resulting in low noise levels.

Although not shown, electrical wiring from the control 120 to the motor 64 can be run as necessary, such as through the sash 16 proximate a hinge or operator arm used for closing or opening the sash 36. The frame 40 is made of a thermally non-conductive material which, when secured, becomes part of the sash 16.

Thus, the invention broadly comprehends a window locking system using a movable keeper controlled by a sash-mounted motor.

I claim:

1. An assembly for use with a window including a window sash movably mounted to a window jamb, the assembly for selectively locking the window sash closed against the window jamb, the assembly comprising:

a motor for mounting to the window sash, said motor having an output drive shaft;

a keeper for mounting to the window sash and being movable relative to the window sash;

means for operably connecting said motor drive shaft to said keeper for controlling movement of said keeper;

a cam member for mounting to the window jamb; and means for controlling said motor to move the keeper to selectively engage the keeper with the cam member when the window sash is substantially closed against the window jamb, wherein said keeper comprises a first keeper and said cam member comprises a first cam member, and further comprises at least a second keeper for movably mounting to the window sash, wherein said second keeper selectively engages a second cam member, the second cam member for mounting to the window jamb, when the sash is substantially closed against the jamb.

2. The assembly of claim 1, further comprising means for interconnecting said first keeper to said second keeper for movement therewith.

3. The assembly of claim 2, wherein said interconnecting means comprises a tie bar.

4. The assembly of claim 1, further comprising means for manually moving said first and second cam members between first and second positions, wherein said first and second cam members engage said first and second keepers only in said first position.

5. The assembly of claim 4, wherein said manually moving means comprises:

actuator means operably connected to said first cam member; and a tie bar interconnecting said first and second cam members together.

6. An assembly for use with a window including a window sash movably mounted to a window jamb, the assembly for selectively locking the window sash closed against the window jamb, the assembly comprising:

a motor for mounting to the window sash, said motor having an output drive shaft;

a keeper for mounting to the window sash and being movable relative to the window sash;

means for operably connecting said motor drive shaft to said keeper for controlling movement of said keeper;

a cam member for mounting to the window jamb;

means for controlling said motor to move the keeper to selectively engage the keeper with the cam member when the window sash is substantially closed against the window jamb; and manually operable means for releasing the operably connecting means to allow said keeper to move independent of said motor drive shaft.

7. An assembly for use with a window including a window sash movably mounted to a window jamb, the assembly for selectively locking the window sash closed against the window jamb, the assembly comprising:

a motor for mounting to the window sash, said motor having an output drive shaft;

a keeper for mounting to the window sash and being movable relative to the window sash;

means for operably connecting said motor drive shaft to said keeper for controlling movement of said keeper;

a cam member for mounting to the window jamb;

means for controlling said motor to move the keeper to selectively engage the keeper with the cam member when the window sash is substantially closed against the window jamb; and a frame disposable in a cavity defined in a generally rectangular box shape on a sash side, said motor and said operably connecting means disposed in said frame.

8. The assembly of claim 7, wherein said frame is comprised of a thermally nonconductive material and is adhesively bondable within the sash cavity.

9. The assembly of claim 7, wherein said operably connecting means comprises a reduction gear set driven by the motor output drive shaft.

10. An assembly for use with a window including a window sash movably mounted to a window jamb, the assembly for selectively locking the window sash closed against the window jamb, the assembly comprising:

a motor for mounting to the window sash, said motor having an output drive shaft;

a gear reducing train operably connected to said motor output drive shaft;

a keeper for mounting to the window sash and being movable relative to the window sash;

means for operably connecting said gear reducing train to said keeper for controlling movement of said keeper;

a cam member for mounting to the window jamb; and means for controlling said motor to selectively engage the keeper with the cam member when the sash is substantially closed against the jamb, wherein said keeper comprises a first keeper and said cam member comprises a first cam member, and further comprises at least a second keeper for movably mounting to the window sash, wherein said second keeper selectively engages a second cam member, the second cam member for mounting to the window jamb, when the sash is substantially closed against the jamb.

11. The assembly of claim 10, further comprising means for interconnecting said first keeper to said second keeper for movement therewith.

12. The assembly of claim 11, wherein said interconnecting means comprises a tie bar.

13. The assembly of claim 10, further comprising means for manually moving said first and second cam members between first and second positions, wherein said first and second cam members engage said first and second keepers only in said first position.

14. The assembly of claim 13, wherein said manually moving means comprises:

actuator means operably connected to said first cam member; and a tie bar interconnecting said first and second cam members together.

15. The assembly of claim 10, wherein said gear reducing train comprises:

a first helical gear rotatable about a first axis, said first helical gear having large and small diameter portions, said large portion of said first helical gear operably connected to a worm gear driven by the motor output shaft; and a second helical gear rotatable about a second axis generally parallel to said first axis, said second helical gear engaging said small diameter portion of said first helical gear and operably connected to said operably connecting means.

16. The assembly of claim 15, wherein said first and second helical gears are EVOLOID gears.

17. The assembly of claim 15, wherein said operably connecting means comprises:

a sliding member connected to said first keeper and having rack teeth axially disposed thereon; and a pinion rotatable about said second axis and selectively connected to said second helical gear, said pinion engaging the rack teeth on said sliding member.

18. The assembly of claim 17, further comprising manually operable means for disconnecting said pinion from said second helical gear.

19. The assembly of claim 18, wherein said manually operable disconnecting means comprises an actuator movable between first and second positions, wherein said actuator selectively connects said pinion with said second helical gear in said first position and disconnects said pinion from said second helical gear in said second position.

20. The assembly of claim 19, wherein said actuator is biased to said first position by a spring.

21. The assembly of claim 19, further comprising a frame disposable in a window sash cavity defined in a generally rectangular box shape on a sash side, said motor, said worm, said wormgear, said gear reducing train, said operably connecting means, and said actuator disposed in said frame, said actuator projecting from said frame for manual operability.

22. The assembly of claim 21, wherein said frame is comprised of a thermally nonconductive material and is adhesively bondable within the sash cavity.

23. An assembly for use with a window including a window sash movably mounted to a window jamb, the assembly for selectively locking the window sash closed against the window jamb, the assembly comprising:

a motor for mounting to the window sash, said motor having an output drive shaft;

a gear reducing train operably connected to said motor output drive shaft wherein said gear reducing train achieves a reduction ratio of approximately 750:1, a keeper for mounting to the window sash and being movable relative to the window sash;

means for operably connecting said gear reducing train to said keeper for controlling movement of said keeper;

a cam member for mounting to the window jamb; and means for controlling said motor to selectively engage the keeper with the cam member when the sash is substantially closed against the jamb.

24. An assembly for use with a window including a window sash movably mounted to a window jamb, the assembly for selectively locking the window sash closed against the window jamb, the assembly comprising:

a cam member for securing to the window jamb;

a keeper for mounting to the window sash and being movable relative to the window sash;

drive means for mounting to the window sash for operably controlling movement of said keeper to selectively engage the keeper with the cam member when the window sash is substantially closed against the window jamb; and means for manually moving said cam member between first and second positions, wherein said cam member engages said keeper only in said first position.

25. The assembly of claim 24, wherein said manually moving means comprises a lever hingedly mounted to said jamb and operably connected to said cam member for moving the cam member.

26. An assembly for use with a window including a window sash movably mounted to a window jamb, the assembly for selectively locking the window sash closed against the window jamb, the assembly comprising:

a cam member for securing to the window jamb, a keeper for mounting to the window sash and being movable relative to the window sash; and drive means for mounting to the window sash for operably controlling movement of said keeper to selectively engage the keeper with the cam member when the window sash is substantially closed against the window jamb, wherein said drive means comprises a motor for mounting to the window sash, a gear reducing train driven by the motor and means and controlling movement of the keeper.

27. The assembly of claim 26, wherein said gear reducing train comprises:

a first helical gear rotatable about a first axis, said first helical gear having large and small diameter portions, said large portion of said first helical gear operably connected to a wormgear driven by the motor; and a second helical gear rotatable about a second axis generally parallel to said first axis, said second helical gear engaging said small diameter portion of said first helical gear and operably connected to said operably connecting means.

28. The assembly of claim 27, wherein said first and second helical gears are EVOLOID gears.

29. The assembly of claim 27, wherein said operably connecting means comprises:

a sliding member connected to said first keeper and having rack teeth axially disposed thereon; and a pinion rotatable about said second axis and selectively connected to said second helical gear, said pinion engaging the rack teeth on said sliding member.

30. The assembly of claim 29, further comprising manually operable means for disconnecting said pinion from said second helical gear.

31. The assembly of claim 30, wherein said manually operable disconnecting means comprises an actuator movable between first and second positions, wherein said actuator selectively connects said pinion with said second helical gear in said first position and disconnects said pinion from said second helical gear in said second position.

32. The assembly of claim 31, wherein said actuator is biased to said first position by a spring.

33. The assembly of claim 31, further comprising a frame disposable in a window sash cavity defined in a generally rectangular box shape on a sash side, said motor, said worm, said wormgear, said gear reducing train, said operably connecting means, and said actuator disposed in said frame, said actuator projecting from said frame for manual operability.

34. The assembly of claim 33, wherein said frame is comprised of a thermally nonconductive material and is adhesively bondable within the sash cavity.

* * * * *